US012465093B2

(12) United States Patent
Teli

(10) Patent No.: US 12,465,093 B2
(45) Date of Patent: Nov. 11, 2025

(54) UNIFORM KITS AND METHODS THEREOF

(71) Applicant: FITORE UNIFORMS. INC., Chicago, IL (US)

(72) Inventor: Fitore Teli, Chicago, IL (US)

(73) Assignee: Fitore Uniforms. Inc., Chicago, IL (US)

( * ) Notice: Subject to any disclaimer, the term of this patent is extended or adjusted under 35 U.S.C. 154(b) by 77 days.

(21) Appl. No.: 18/144,887

(22) Filed: May 9, 2023

(65) Prior Publication Data

US 2023/0354924 A1 Nov. 9, 2023

Related U.S. Application Data

(60) Provisional application No. 63/339,579, filed on May 9, 2022.

(51) Int. Cl.

| | |
|---|---|
| ***A41D 1/04*** | (2006.01) |
| ***A41D 13/015*** | (2006.01) |
| ***A41D 27/20*** | (2006.01) |
| ***F41H 1/02*** | (2006.01) |

(52) U.S. Cl.

CPC ..... *A41D 1/04* (2013.01); *A41D 13/015* (2013.01); *A41D 27/20* (2013.01); *F41H 1/02* (2013.01); *A41D 2300/33* (2013.01)

(58) Field of Classification Search

CPC ..... A41D 1/04; A41D 13/015; A41D 27/20; A41D 2300/33; F41H 1/02

See application file for complete search history.

(56) References Cited

U.S. PATENT DOCUMENTS

| | | | | | |
|---|---|---|---|---|---|
| 4,697,285 | A * | 10/1987 | Sylvester | F41H 1/02 | 2/2.5 |
| 5,008,959 | A * | 4/1991 | Coppage, Jr. | F41H 1/02 | 2/2.5 |
| 5,157,792 | A * | 10/1992 | Allen | F41H 1/02 | 2/92 |
| 5,373,582 | A * | 12/1994 | Dragone | F41H 1/02 | 2/2.5 |
| 6,029,270 | A * | 2/2000 | Ost | A41D 27/04 | 2/2.5 |
| 2011/0023201 | A1* | 2/2011 | Pearl | F41H 1/02 | 2/2.5 |
| 2014/0130224 | A1* | 5/2014 | Lurio | A41F 3/02 | 2/2.5 |
| 2015/0211829 | A1* | 7/2015 | Cole | F41H 1/02 | 2/463 |

(Continued)

*Primary Examiner* — Haley A Smith
(74) *Attorney, Agent, or Firm* — Nixon Peabody LLP

(57) ABSTRACT

A vest cover kit for making a customizable vest cover includes a front and back cover configured to cover at least a portion of a user's chest and back, respectively, a front lining configured to be coupled to an inner surface of the front cover, the front lining including a first pre-installed closure mechanism that allows for insertion of a first insert, a back lining configured to be coupled to an inner surface of the back cover, the back lining including a second pre-installed closure mechanism that allows for insertion of a second insert, a pair of epaulets configured to be secured to one or more of the front cover and the back cover, and at least one side strap, wherein the side strap is configured to be removably secured to the front cover and the back cover to secure the customizable vest cover on the user.

20 Claims, 7 Drawing Sheets

(56) References Cited

U.S. PATENT DOCUMENTS

| | | | | |
|---|---|---|---|---|
| 2016/0116255 | A1* | 4/2016 | Billotte | F41H 1/02 2/2.5 |
| 2016/0238347 | A1* | 8/2016 | Blauer | A41D 3/005 |
| 2018/0160744 | A1* | 6/2018 | Blauer | F41H 1/02 |
| 2019/0183192 | A1* | 6/2019 | Lin | A45F 3/04 |
| 2019/0353464 | A1* | 11/2019 | Nardone | A41D 1/04 |

* cited by examiner

UNIFORM KITS AND METHODS THEREOF

TECHNICAL FIELD

This invention relates generally to uniforms and, more specifically, kits containing the necessary components to assemble a uniform.

BACKGROUND

Some employers require their employees to be dressed in specific uniforms. For example, employees such as law enforcement officers, nurses, firefighters, emergency medical technicians (EMTs), etc. often wear specific uniforms associated with their employment. In some cases, employers do not provide their employees with the required uniforms, instead requiring employees to acquire their own uniform from a uniform vendor. Additionally, if the employer provides the required uniform, the employer often acquires the uniform from a uniform vendor. Further, some jobs require protective padding or additional clothing underneath the uniform, which requires the uniform to be configured to receive such padding. Adding to the customization is that some employers require uniforms that have decorative features (e.g., name tags, regalia, etc.). Due to the customization required for the uniforms, uniform vendors create customized uniforms from scratch. Unfortunately, creating customized uniforms is costly, time-consuming, and inefficient. Consequently, a need exists for methods and apparatuses that minimize the expense and time spent in manufacturing a customized uniform while ensuring the uniform properly fits each customer for the customer's specific needs.

BRIEF DESCRIPTION OF THE DRAWINGS

Disclosed herein are embodiments of methods and apparatuses pertaining to providing a kit including the necessary parts to efficiently manufacture a work uniform. This description includes drawings, wherein.

Figure 1:
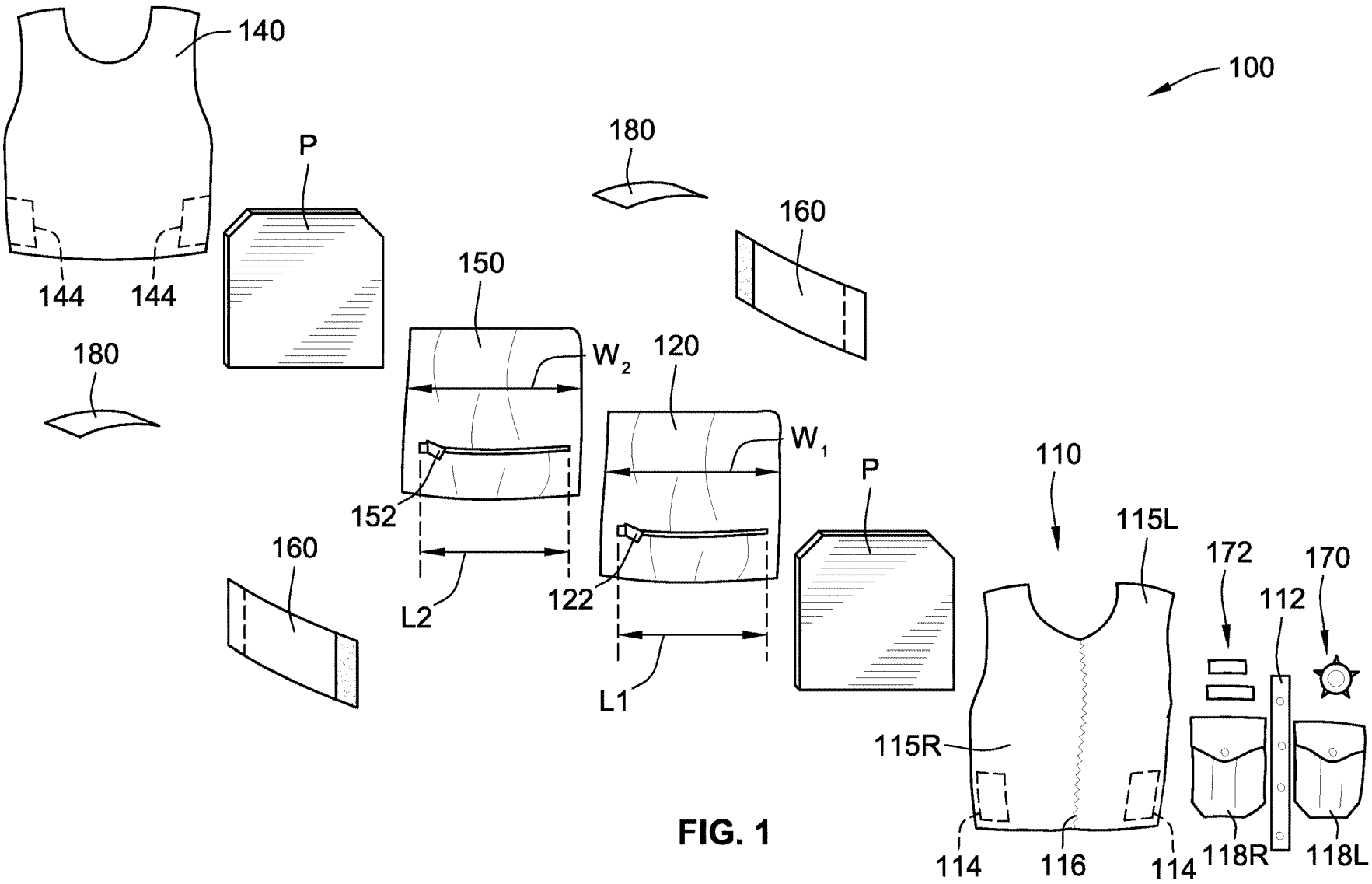
FIG. 1 is an exploded view of a vest cover kit for a uniform vest cover, according to some embodiments.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to various embodiments, apparatuses and methods are provided herein useful to create and assemble a uniform. In some embodiments, a vest cover kit for making a customizable vest cover comprises a front cover configured to cover at least a portion of a user's chest, the front cover having at least one pre-installed internal pocket, a front lining configured to be coupled to an inner surface of the front cover, the front lining including a first pre-installed closure mechanism, wherein the first pre-installed closure mechanism allows for insertion of a first insert when the front lining is coupled to the inner surface of the front cover, a back cover configured to cover at least a portion of the user's back, a back lining configured to be coupled to an inner surface of the back cover, the back lining including a second pre-installed closure mechanism, wherein the second pre-installed closure mechanism allows for insertion of a second insert when the back lining is coupled to the inner surface of the back cover, a pair of epaulets configured to be secured to one or more of the front cover and the back cover, and at least one side strap, wherein the at least one side strap is configured to be removably secured to the front cover and the back cover to secure the vest on the user.

As previously discussed, employers may require their employees to acquire customized uniforms. Uniforms can be customized in many ways. For example, uniforms can be customized based on the wearer's body dimensions and/or fit preferences. As another example, uniforms can be customized by adding name tags, emblems, regalia, etc. Often, law enforcement officers often are required to obtain their own uniform, including a bulletproof vest cover. Typically, the bullet proof vest cover is customized based on the wearer's body dimensions and/or fit preferences, as well as with one or more of name tags, emblems, regalia, etc. As another such example, firefighters often require fire-resistant uniforms customized based on the wearer's body dimensions and/or fit preferences that may include customized name tags, emblems, and/or protective padding or additional clothing underneath the uniform, which requires the uniform to be configured to receive such padding. Employees who require customized uniforms often go to a uniform vendor, and the uniform vendor makes the customized uniform from scratch. That is, the uniform vendor must take the customer's body measurements and discuss any other decorative features of the uniform that the customer requires. Next, the uniform vendor may have to order the required materials (e.g., fire-resistant fabric, heavy-duty fabric, etc.). Then the uniform vendor will cut individual pieces from spools of fabric based on the customer's body measurements and/or fit preferences. Upon obtaining the necessary materials, the uniform vendor must rough cut the fabric into a general shape (e.g., cut a chest portion, a back portion, sleeves, etc.). Next, the uniform vendor must tailor the materials to the customer's body dimensions and/or fit preferences, and attach any desired/required decorative features. Finally, the uniform vendor must assemble the uniform. Accordingly, the ordinary process for obtaining a customized uniform is expensive, time-consuming, and inefficient.

Described herein are systems, methods, and apparatuses that seek to minimize, if not eliminate, these problems by allowing uniform vendors to create and assemble uniforms quickly and affordably from a pre-made kit. In one embodiment, uniform vendors are provided with a kit that includes all of the necessary pieces to make a customized uniform that suits the customer's needs. In one embodiment, a uniform vendor is provided with a vest cover kit used to make a customizable vest cover for a law enforcement officer's bullet proof vest. The vest cover kit includes all the necessary pieces to retain the police officer's bullet proof plates and/or protective padding. Further, in some embodiments, the vest cover kit also provides the required decorative features, such as a name tag, police department emblem, etc. Once a uniform vendor obtains a vest cover kit, the uniform vendor can trim each component to the customer's bodily dimension and/or fit preferences (if necessary) and sew the components of the vest cover kit together. Obtaining and using these vest cover kits to make uniforms eliminates, or at least reduces, the need to bulk order material (e.g., fabric, name tags, department specific logos, etc.), thereby saving the uniform vendor the expensive of ordering and storing such material. Using vest cover kits also streamlines a time-consuming process by eliminating some steps that uniform vendors often take in preparing a custom uniform. For example, the vest cover kit only requires the uniform vendor to trim the kit components to the user's body dimensions (if necessary) and assemble the components, thereby eliminating the need to obtain, store, and rough cut the bulk material. Also, in some embodiments, the vest cover kit can include the department-specific logos or emblems that customers require. Therefore, the vest cover kit allows the uniform vendors to assemble the vest cover more quickly and efficiently, allowing the customer to receive their customized uniform faster, ultimately reducing time spent for both the uniform vendor and the customer. The discussion of FIG. 1 provides an overview of an example vest cover kit.

FIG. 1 is an exploded view of a vest cover kit for a uniform vest cover 100 in accordance with some embodiments. As depicted in FIG. 1, the uniform vest cover kit 100 includes a front cover portion 110, a front lining 120, a back cover portion 140, a back lining 150, at least one side strap 160, and a pair of epaulets 180. The front cover portion 110 includes a left portion 115L, a right portion 115R, and at least one front fastener 114. In some embodiments, the front cover portion 110 optionally includes two decorative creases and/or pleats. The front cover portion 110 is dimensioned to wrap around and cover at least a portion of a user's chest. The front cover portion 110 can be made from any suitable material(s). For example, the front cover portion 110, including the left portion 115L and the right portion 115R, can be made from one or a combination of nylon, polyester, polycotton, cotton spandex, rayon, etc. In some embodiments, one of the left portion 115L and the right portion 115R can include decorative buttons 112. For example, as depicted in FIG. 1, the left portion 115L of the front cover portion 110 includes a plurality of decorative buttons 112. Additionally, as depicted in FIG. 1 the left portion 115L also includes a pocket 118L, and one-half of a mating feature 116. In this example, the right portion 115R of the front cover portion 110 includes the other half of the mating feature 116 and a pocket 118R. The right portion 115R and the left portion 115L are mated via the mating feature 116. According to some embodiments, the mating feature 116 can be a zipper, hook and loop fastener, male-female connectors, or any other type of mechanism that would mate the right portion 115R with the left portion 115L. In this embodiment, the decorative buttons 112 are non-functional. However, in alternative embodiments, the decorative buttons 112 can be used in lieu of, or in addition to, the mating feature 116 to mate the right portion 115R to the left portion 115L.

The front lining 120 can be made from any suitable material(s). For example, the front lining 120 can be made from one or a combination of nylon, polyester, polycotton, cotton spandex, rayon, etc. In the example depicted in FIG. 1, the front lining 120 includes a pre-installed closure mechanism 122. The pre-installed closure mechanism 122 runs across a width W1 of the front lining 120; however, the length L1 of the pre-installed closure mechanism 122 is less than the width W1 of the front lining 120. It should be noted, however, that the pre-installed closure mechanism 122 may run in any desired direction (e.g., across a length of the front lining, diagonally across the front lining, etc.). Further, the pre-installed closure mechanism 122 can take any suitable form. For example, the pre-installed closure mechanism 122 can be a zipper, a plurality of buttons, snap buttons, hook and loop fasteners, etc. When the front lining 120 is coupled to the front cover portion 110, a user can actuate the closure mechanism 122 to an open position and insert an insert (e.g., the bullet proof plate P) such that the insert is between the front lining 120 and the front cover portion 110. If the user were to then close the pre-installed closure mechanism 122, the insert would be securely retained between the front lining 120 and the front cover portion 110. As shown in more detail in FIG. 2, the front lining 120 is dimensioned to fit within the boundary of an inner surface 113 of the front cover portion 110. When assembled, the outer edges of the front lining 120 are coupled to the front cover portion 110.

The back cover portion 140 is dimensioned to wrap around and cover at least a portion of a user's back. The back cover portion 140 can be made from any suitable material(s). For example, the back cover portion 140 can be made from one or a combination of nylon, polyester, polycotton, cotton, spandex, rayon, etc. In the example depicted in FIG. 1, the back cover portion 140 includes at least one rear fastener 144. In some embodiments, the back cover portion 140 optionally includes decorative creases and/or pleats.

The back lining 150 can be made from any suitable material(s). For example, the back lining 150 can be made from one or a combination of nylon, polyester, polycotton, cotton spandex, rayon, etc. Similar to the front lining 120, the back lining 150 includes a pre-installed closure mechanism 152. The pre-installed closure mechanism 152 runs across a width W2 of the back lining 150; however the length L2 of the pre-installed closure mechanism 152 is less than the width W2 of the back lining 150. It should be noted, however, that the pre-installed closure mechanism 152 may run in any desired direction (e.g., across a length of the front lining, diagonally across the front lining, etc.). Further, the pre-installed closure mechanism 152 can take any suitable form. For example, the pre-installed closure mechanism 152 can be a zipper, a plurality of buttons, snap buttons, hook and loop fasteners, etc. When the back lining 150 is coupled to the back cover portion 140, a user can actuate the pre-installed closure mechanism 152 to an open position and insert an insert (e.g., a bullet proof plate P), such that the insert is between the back lining 150 and the back cover portion 140. If the user were to then close the pre-installed closure mechanism 152, the insert would be securely retained between the back lining 150 and the back cover portion 140. The back lining 150 is dimensioned to fit within the boundary of a rear surface 143 (FIG. 2) of the back cover portion 140. When assembled, the outer edges of the back lining 150 are coupled to the back cover portion 140.

In the embodiment shown in FIG. 1, the side straps 160 function to mate the front cover portion 110 with the back cover portion 140 when the uniform vest cover kit 100 is assembled. In alternative embodiments, the front cover portion 110 can be mated to the back cover portion 140 through a zipper, snap buttons, hook and loop fasteners, male-female connectors, etc. Referring to the embodiment depicted in FIG. 1, the side straps 160 include an elastic portion 164 and a pair of fastening portions 162. The fastening portions 162 are sewn onto outer ends of the elastic portion 164. One of the fastening portions 162 is used to engage the front fastener 114 of the front cover portion 110 while the other fastening portion 162 is used to engage the rear fastener 144 of the back cover portion 140. As depicted in FIG. 1, the fastening portions 162, the front fastener 114 and the rear fastener 144 are hook and loop fasteners. In other embodiments, the fastening portions 162, the front fastener 114 and the rear fastener 144 can be zippers, male-female connectors, or any other type of mechanism that would fasten each fastening portion 162 with the respective front fastener 114 and the rear fastener 144. The elastic portion 164 allows the strap to bend, stretch, contort, or otherwise be positioned to allow for the fastening portions 162 to engage the front fastener 114 of the front cover portion 110 and the rear fastener 144 of the back cover portion 140. In the embodiment shown in FIG. 1, the uniform vest cover kit 100 includes two side straps 160, the front cover portion 110 includes two front fasteners 114, and the back cover portion 140 includes two rear fasteners 144. However, the disclosure is not so limiting. In some embodiments, the uniform vest cover kit 100 can include any desired amount of side straps 160 and a corresponding number of front fasteners 114 and rear fasteners 144. For example, in some embodiments, the uniform vest cover kit 100 can include 1, 3, 4, 6, 10, etc. side straps 160 and a corresponding number of front fasteners 114 and rear fasteners 144.

In the embodiment shown in FIG. 1, the epaulets 180 can be attached to the front cover portion 110, the back cover portion 140, or a combination of the front cover portion 110 and the back cover portion 140. The epaulets 180 can be both decorative and functional. For example, the epaulets 180 can be used to secure equipment (e.g., wired headset, wired earpiece, etc.) to an assembled uniform vest cover kit 100.

The uniform vest cover kit 100 also optionally includes a name tag 172 and an emblem 170. In the embodiment shown in FIG. 1, both the name tag 172 and the emblem 170 are coupled to the front cover portion 110. However, the name tag 172 and the emblem 170 could, in an alternative embodiment, be coupled to the back cover portion 140. Further, the name tag 172 and the emblem 170 are exemplary components showing possible combinations of decorative features for the uniform vest cover kit 100. The uniform vest cover kit 100 could also include additional pockets, regalia, logos, signs, or any other type of decorative and/or functional accessory.

Figure 2:
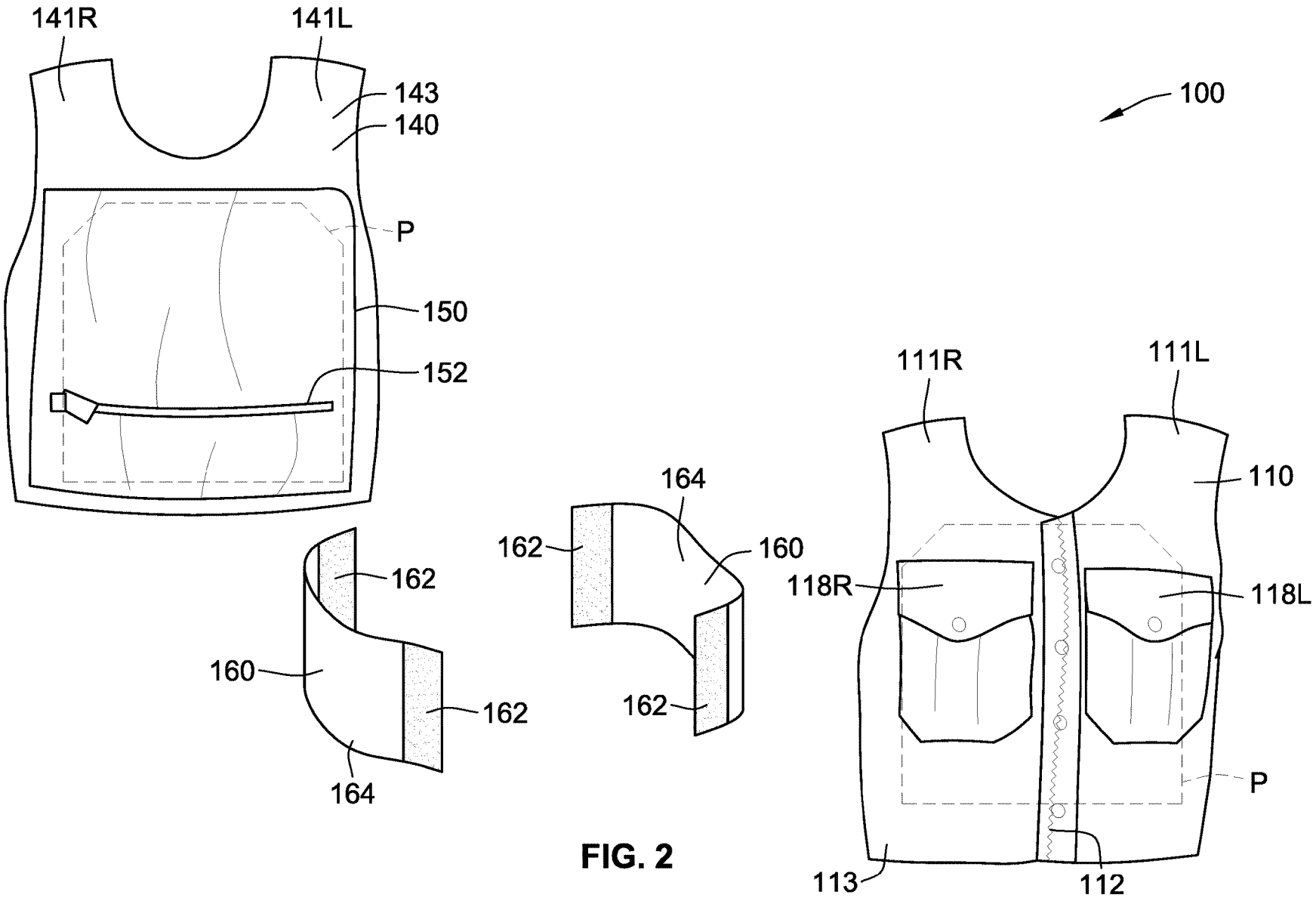
FIG. 2 is a perspective view of a partially assembled uniform vest cover assembled from a vest cover kit, according to some embodiments.
Figure 3:
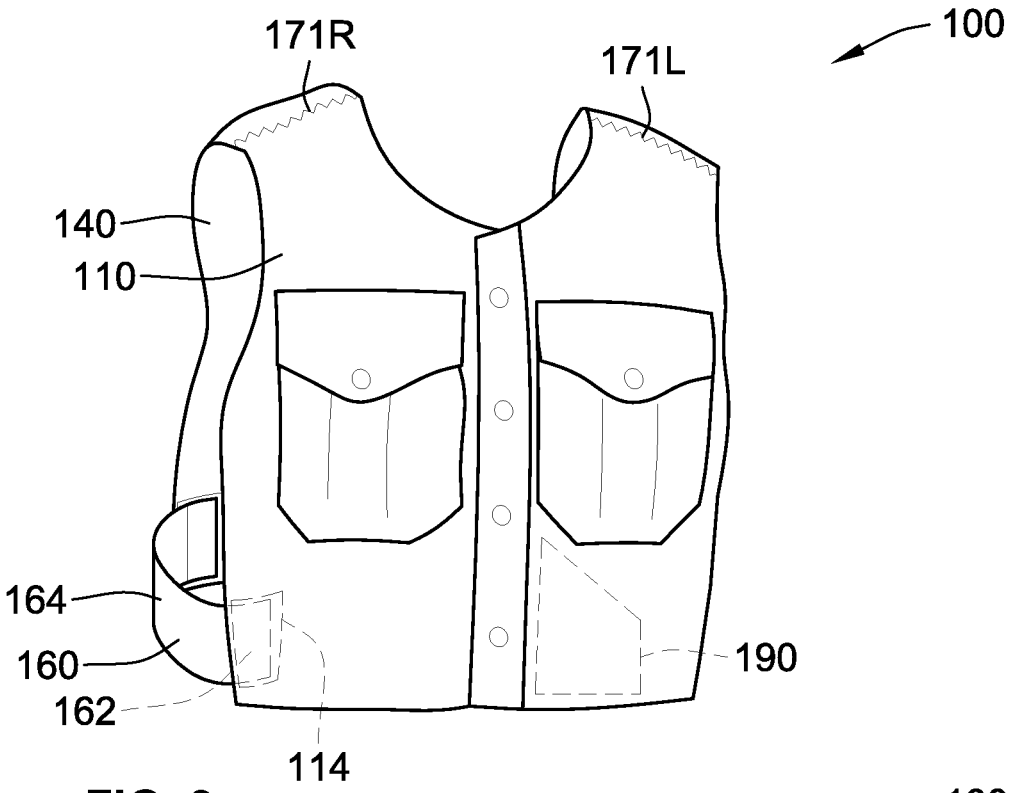
FIG. 3 is perspective view of an assembled uniform vest cover assembled from a vest cover kit, according to some embodiments.
Figure 4:
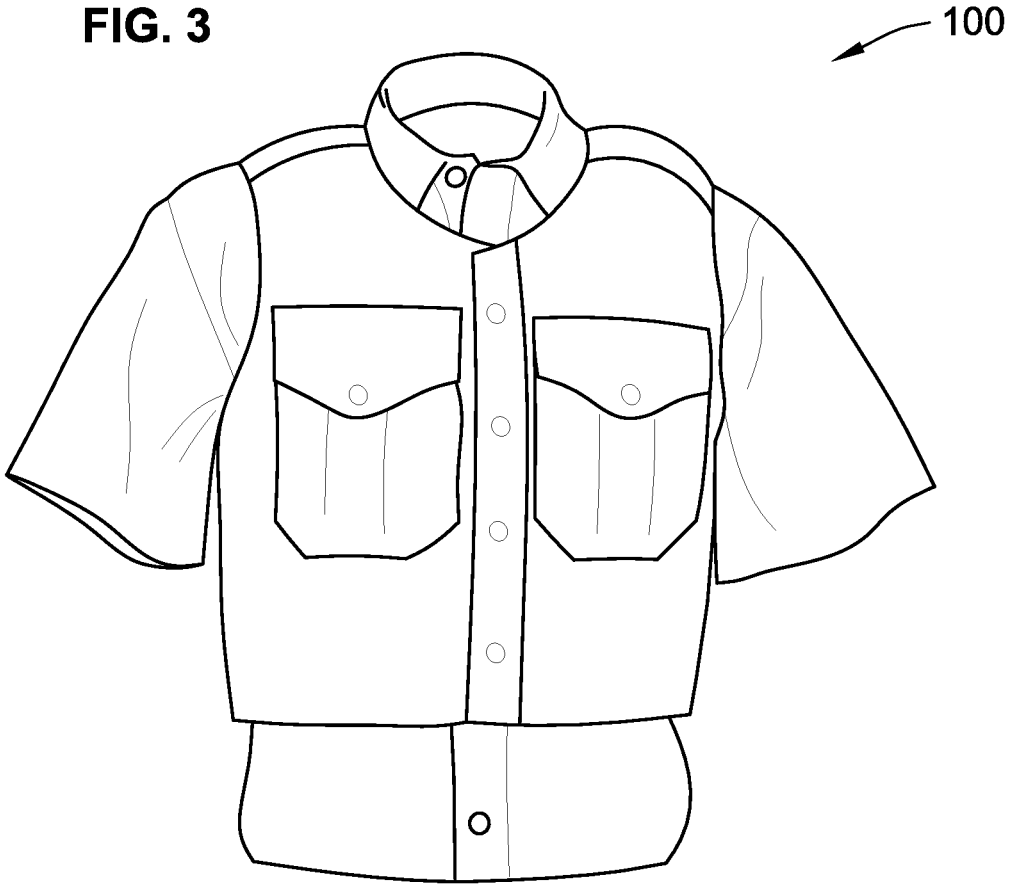
FIG. 4 is a perspective view of an assembled uniform vest cover assembled from a vest cover kit, according to some embodiments.

While the discussion of FIG. 1 provides an overview of an example vest cover kit, the discussion of FIGS. 2-4 provide additional detail regarding such a vest cover kit.

FIG. 2 is a perspective view of a partially assembled uniform vest cover assembled from a uniform vest cover kit 100, according to some embodiments. As depicted in FIG. 2, the front cover portion 110 and the back cover portion 140 of the uniform vest cover kit 100 are partially assembled. Specifically, the front lining 120 is coupled to the front cover portion 110 such that the insert (e.g., bullet proof plate P) is secured between the front lining 120 and the front cover portion 110, as discussed with respect to FIG. 1. The insert is inserted between the front lining 120 and the front cover portion 110 through the pre-installed closure mechanism 122. The back lining 150 is coupled to the back cover portion 140 such that the insert is secured between the back lining 150 and the back cover portion 140, as discussed with respect to FIG. 1. In this embodiment, the insert is inserted between the back lining 150 and the back cover portion 140 through the pre-installed closure mechanism 152. When assembling the uniform vest cover from the uniform cover kit 100, the front right shoulder edge 111R of the front cover portion 110 is coupled to the rear right shoulder edge 141R of the back cover portion 140 and the front left shoulder edge 111L of the front cover portion 110 is coupled to the rear left shoulder edge 141L of the back cover portion 140.

FIG. 3 is perspective view of an assembled uniform vest cover assembled from a uniform vest cover kit 100, according to some embodiments. As depicted in FIG. 3, the front cover portion 110 is coupled to the back cover portion 140. The front cover portion 110 and the back cover portion 140 are coupled at the right shoulder 171R and the left shoulder 171L. The embodiment depicted in FIG. 3 also includes a pocket liner 190. The pocket liner 190 is sewn onto the front cover portion 110 so as to function as an internal pocket for the user. In some embodiments, depending on the dimensions of the front cover portion 110, the front liner 120, and the pocket liner 190, the pocket liner 190 can be sewn onto the front liner 120. For example, if the user desires to insert large bullet proof plates into the assembled uniform vest cover kit 100, the front liner 120 can be dimensioned to allow insertion of the bullet proof plate. In such a situation, the front liner 120 is sewn onto a larger area of the inner surface 113 of the front cover portion 110 compared to a scenario in which the user has smaller bullet proof plates and a smaller dimension of the front liner 120. The pocket liner 190 is then sewn onto the front liner 120 so as to allow the user to use the pocket liner 190 as an internal pocket.

In the embodiment depicted in FIG. 3, the user can utilize the side strap 160 to additionally secure the front cover portion 110 to the back cover portion 140. As discussed with respect to FIG. 1, the side strap 160 has an elastic portion 164, which allows users adjust the fit of the assembled uniform cover vest kit 100 because the elastic portion 164 stretches, bends, and/or contorts. The fastening portion 162 of the side strap 160 is secured to the front fastener 114 of the front cover portion and the rear fastener 144 of the back cover portion. As discussed with respect to FIG. 1, alternative means of securing the front cover portion 110 to the back cover portion 140 are contemplated. For example, alternative embodiments can use zippers, snap buttons, hook and loop fasteners, or male and female connectors to secure the front cover portion 110 to the back cover portion 140.

FIG. 4 is a perspective view of an assembled uniform vest cover 100 assembled from a uniform vest cover kit 100, according to some embodiments. As depicted in FIG. 4, the user is wearing the assembled uniform vest cover kit 100.

The uniform vest cover kit 100 has been customized for the user because each component of the vest cover kit 100 is trimmed according to the user's body dimensions and/or fit preferences. As discussed with respect to FIGS. 1 and 3, the elastic portion 164 of the side strap 160 aids in obtaining for the user his or her desired fit for the assembled uniform vest cover kit 100 by contorting to the user's body dimensions. If the user desires a snugger or looser fit, the user could adjust how the fastening portions 162 of the side strap 160 fasten to the front fastener 114 of the front cover portion 110 and the rear fastener 144 of the back cover portion 140.

While the discussion of FIGS. 1-4 describes a vest cover kit for a uniform vest cover, the discussion of FIGS. 5-8 describes a vest cover kit for a tactical vest cover.

Figure 5:
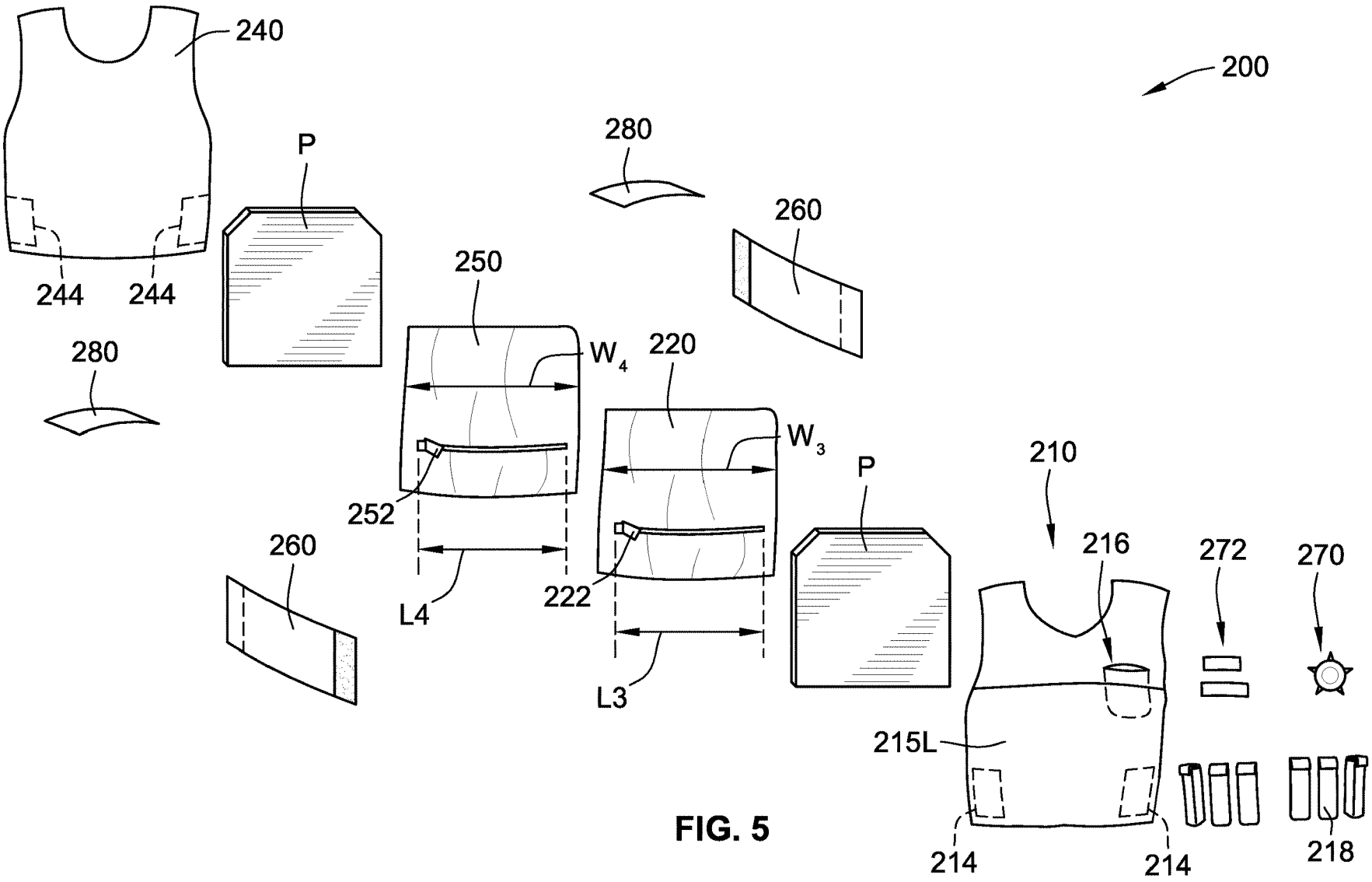
FIG. 5 an exploded view of a vest cover kit for a tactical vest cover, according to some embodiments.

FIG. 5 is an exploded view of a vest cover kit for a tactical vest cover 200, according to some embodiments. As depicted in FIG. 5, the tactical vest cover kit 200 includes a front cover portion 210, a front lining 220, a back cover portion 240, a back lining 250, at least one side strap 260, and a pair of epaulets 280. The front cover portion 210 includes at least one front fastener 214 and one or more internal pockets 216 The front cover portion 210 is dimensioned to wrap around and cover at least a portion of a user's chest. The front cover portion 210 can be made from any suitable material(s). For example, the front cover portion 210 can be made from one or a combination of nylon, polyester, polycotton, cotton spandex, rayon, etc. In the embodiment shown in FIG. 5, the front cover portion 210 includes one internal pocket 216; however, the disclosure is not so limiting. In some embodiments, the front cover portion includes two, three, four, etc. internal pockets 216. In some embodiments, the front cover portion 210 includes a plurality of tactical pockets 218. The front cover portion also optionally includes a name tag 272 and an emblem 270. In the embodiment shown in FIG. 5, both the name tag 272 and the emblem 270 are coupled to front cover portion 210. However, the name tag 272 and the emblem 270 could, in an alternative embodiment, be coupled to the back cover portion 240, Further, the name tag 272 and the emblem 270 are exemplary components showing possible combinations of decorative features for the tactical vest cover kit 200. The tactical vest cover kit 200 could also include additional pockets, regalia, logos, signs, or any other type of decorative and/or functional accessory.

The front lining 220 can be made from any suitable material(s). For example, the front lining 220 can be made from one or a combination of nylon, polyester, polycotton, cotton spandex, rayon, etc. In the example depicted in FIG. 5, the front lining 220 includes a pre-installed closure mechanism 222. The pre-installed closure mechanism 222 runs across a width W3 of the front lining 220; however, the length L3 of the pre-installed closure mechanism 222 is less than the width W3 of the front lining 220. It should be noted, however, that the pre-installed closure mechanism 222 may run in any desired direction (e.g., across a length of the front lining, diagonally across the front lining, etc.). Further, the pre-installed closure mechanism 222 can take any suitable form. For example, the pre-installed closure mechanism 222 can be a zipper, a plurality of buttons, snap buttons, hook and loop fasteners, etc. When the front lining 220 is coupled to the front cover portion 210, a user can actuate the closure mechanism 222 to an open position and insert an insert (e.g., the bullet proof plate P) such that the insert is between the front lining 220 and the front cover portion 210. If the user were to then close the pre-installed closure mechanism 222, the insert would be securely retained between the front lining 220 and the front cover portion 210. As shown in more detail in FIG. 6, the front lining 220 is dimensioned to fit within the boundary of an inner surface 213 of the front cover portion 210. When assembled, the outer edges of the front lining 220 are coupled to the front cover portion 210. If more than the outer edges of the front lining 220 are coupled to the front cover portion 210 (e.g., the middle of the front lining 220 is sewn into the front cover portion 210), it would not be possible to insert the insert between the front lining 220 and the front cover portion 210 through the pre-installed closure mechanism 222.

The back cover portion 240 is dimensioned to wrap around and cover at least a portion of a user's back. The back cover portion 240 can be made from any suitable material(s). For example, the back cover portion 240 can be made from one or a combination of nylon, polyester, polycotton, cotton, spandex, rayon, etc. In the example depicted in FIG. 1, the back cover portion 240 includes at least one rear fastener 244.

The back lining 250 can be made from any suitable material(s). For example, the back lining 250 can be made from one or a combination of nylon, polyester, polycotton, cotton spandex, rayon, etc. Similar to the front lining 220, the back lining 250 includes a pre-installed closure mechanism 252. The pre-installed closure mechanism 252 runs across a width W4 of the back lining 250; however the length L4 of the pre-installed closure mechanism 252 is less than the width W4 of the back lining 250. It should be noted, however, that the pre-installed closure mechanism 252 may run in any desired direction (e.g., across a length of the front lining, diagonally across the front lining, etc.). Further, the pre-installed closure mechanism 252 can take any suitable form. For example, the pre-installed closure mechanism 252 can be a zipper, a plurality of buttons, snap buttons, hook and loop fasteners, etc. When the back lining 250 is coupled to the back cover portion 240, a user can actuate the closure mechanism 252 to an open position and insert an insert (e.g., bullet proof plate P) such that the insert is between the back lining 250 and the back cover portion 240. If the user were to then close the pre-installed closure mechanism 252, the insert would be securely retained between the back lining 250 and the back cover portion 240. The back lining 250 is dimensioned to fit within the boundary of a rear surface 243 (FIG. 7) of the back cover portion 240. When assembled, the outer edges of the back lining 250 are coupled to the back cover portion 240. If more than the outer edges of the back lining 250 are coupled to the back cover portion 240 (e.g., the middle of the back lining 250 is sewn into the back cover portion 240), it would not be possible to insert the insert between the back lining 250 and the back cover portion 240 through the pre-installed closure mechanism 252.

In the embodiment shown in FIG. 5, the side straps 260 function to mate the front cover portion 210 with the back cover portion 240 when the tactical vest cover kit 200 is assembled. In alternative embodiments, the front cover portion 210 can be mated to the back cover portion 240 through a zipper, snap buttons, hook and loop fasteners, male-female connectors, etc. Referring to the embodiment depicted in FIG. 5, the side straps 260 include an elastic portion 264 and a pair of fastening portions 262. The fastening portion 262 are sewn onto outer ends of the elastic portion 264. One of the fastening portions 262 is used to engage the front fastener 214 of the front cover portion 210 while the other fastening portion 262 is used to engage the rear fastener 244 of the back cover portion 240. As depicted in FIG. 5, the fastening portions 262, the front fastener 214, and the rear fastener 244 are hook and loop fasteners. In other embodiments, the fastening portions 262, the front fastener 214, and the rear fastener 244 can be zippers, male-female connectors, or any other type of mechanism that would fasten each fastening portion 262 with the respective front fastener 214 and the rear fastener 244. The elastic portion 264 allows the strap to bend, stretch, contort, or otherwise be positioned to allow for the fastening portions 262 to engage the front fastener 214 of the front cover portion 210 and the rear fastener 244 of the back cover portion 240. In the embodiment shown in FIG. 5, the tactical vest cover kit 200 includes two side straps 260, the front cover portion 210 includes two front fasteners 214, and the back cover portion 240 includes two rear fasteners 244. However, the disclosure is not so limiting. In some embodiments, the tactical vest cover kit 200 can include any desired amount of side straps 260 and a corresponding number of front fasteners 214 and rear fasteners 244. For example, in some embodiments, the tactical vest cover kit 200 can include 1, 3, 4, 6, 10, etc. side straps 260 and a corresponding number of front fasteners 214 and rear fasteners 244.

In the embodiment shown in FIG. 5, the epaulets 280 can be attached to the front cover portion 210, the back cover portion 240, or a combination of the front cover portion 210 and the back cover portion 240. The epaulets 280 can be both decorative and functional. For example, the epaulets 280 can be used to secure equipment (e.g., wired headset, wired earpiece, etc.) to an assembled tactical vest cover kit 200.

Figure 6:
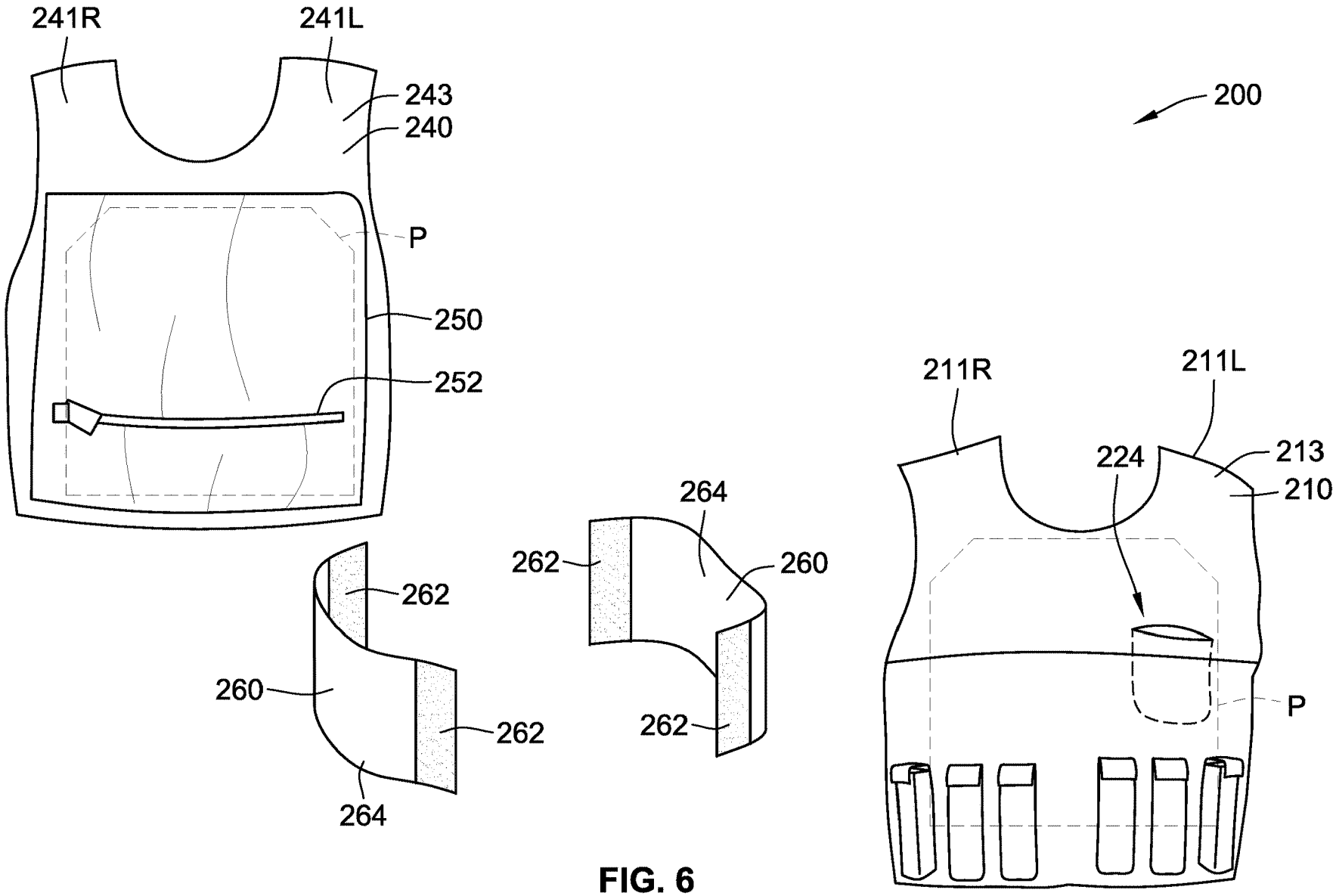
FIG. 6 is a perspective view of a partially assembled tactical vest cover assembled from a vest cover kit, according to some embodiments.
Figure 7:
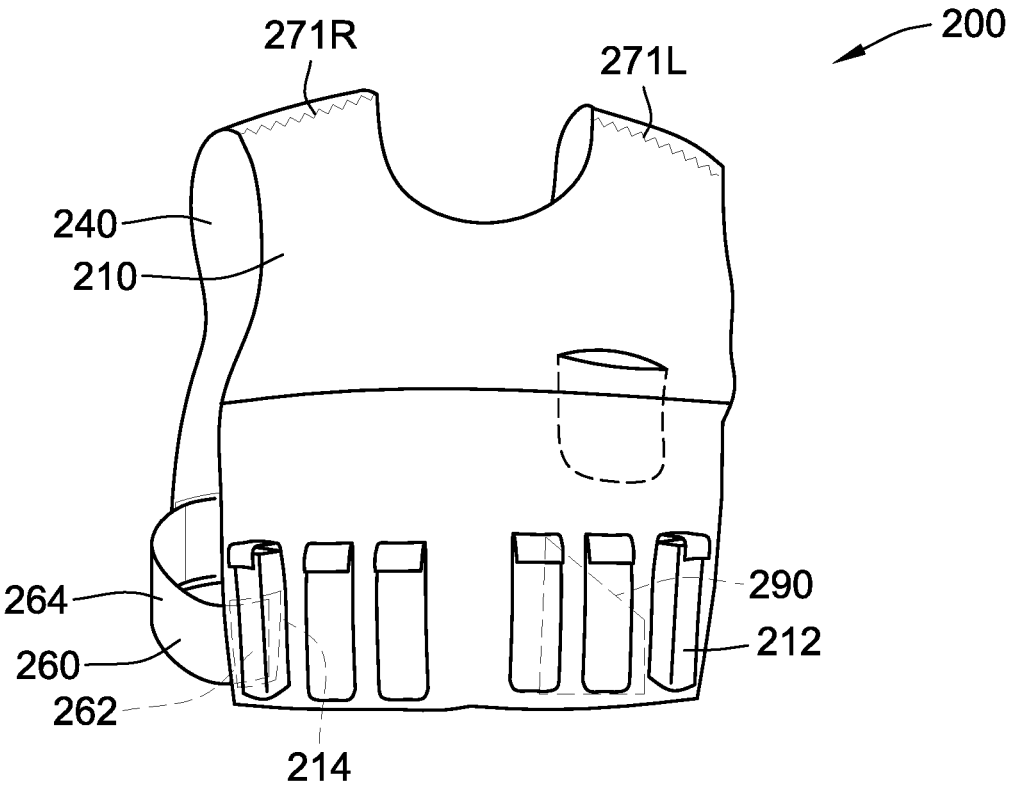
FIG. 7 is perspective view of an assembled tactical vest cover assembled from a vest cover kit, according to some embodiments.
Figure 8:
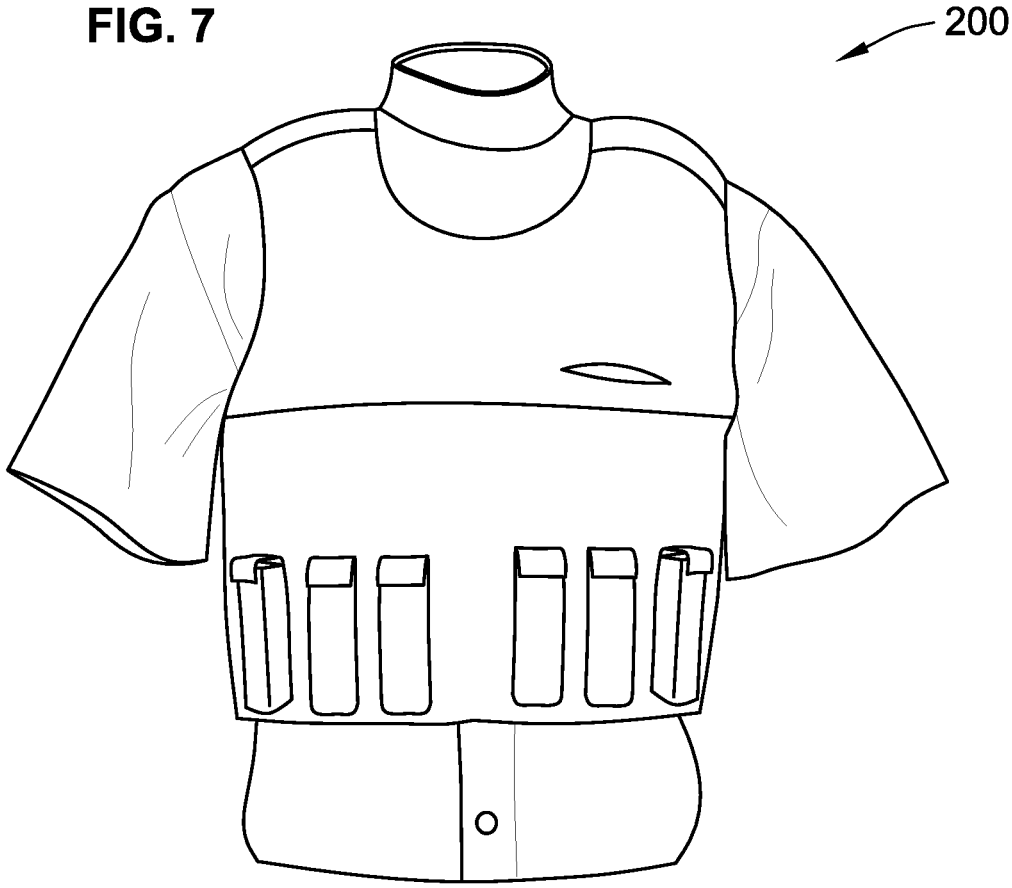
FIG. 8 is a perspective view of an assembled tactical vest cover assembled from a vest cover kit, according to some embodiments.

While the discussion of FIG. 5 provides an overview of an example vest cover kit, the discussion of FIGS. 6-8 provide additional detail regarding such a vest cover kit.

FIG. 6 is a perspective view of a partially assembled tactical vest cover assembled from a tactical uniform vest cover kit 200, according to some embodiments. As depicted in FIG. 6, the front cover portion 210 and the back cover portion 240 of the tactical vest cover kit 200 are partially assembled. Specifically, the front lining 220 is coupled to the front cover portion 210 such that the insert (e.g., bullet proof plate P) is secured between the front lining 220 and the front cover portion 210, as discussed with respect to FIG. 1. The insert is inserted between the front lining 220 and the front cover portion 210 through the pre-installed closure mechanism 222. The back lining 250 is coupled to the back cover portion 240 such that the insert is secured between the back lining 250 and the back cover portion 240. In this embodiment, the insert is inserted between the back lining 250 and the back cover portion 240 through the pre-installed closure mechanism 252. When assembling the tactical vest cover from the tactical vest cover kit 200, the front right shoulder edge 211R of the front cover portion 210 is coupled to the rear right shoulder edge 241R of the back cover portion 240 and the front left shoulder edge 211L of the front cover portion 210 is coupled to the rear left shoulder edge 241L of the back cover portion 240.

FIG. 7 is perspective view of an assembled tactical vest cover assembled from a tactical vest cover kit 200, according to some embodiments. As depicted in FIG. 7, the front cover portion 210 is coupled to the back cover portion 240. The front cover portion 210 and the back cover portion 240 are coupled at the right shoulder 271R and the left shoulder 271L. The embodiment depicted in FIG. 7 also includes the pocket liner 290. The pocket liner 290 is sewn onto the front cover portion 210 so as to function as an internal pocket for the user. In some embodiments, depending on the dimensions of the front cover portion 210, the front liner 220, and the pocket liner 290, the pocket liner 290 can be sewn onto the front liner 220. For example, if the user desires to insert large bullet proof plates into the assembled tactical vest cover kit 200, the front liner 220 can be dimensioned to allow insertion of the bullet proof plates. In such a situation, the front liner 220 is sewn onto a larger area of the inner surface 213 of the front cover portion 210 compared to a scenario in which the user has smaller bullet proof plates and a smaller dimension of the front liner 220. The pocket liner 290 is then sewn onto the front liner 220 so as to allow the user to use the pocket 290 as an internal pocket.

In the embodiment depicted in FIG. 7, the user can utilize the side strap 260 to additionally secure the front cover portion 210 to the back cover portion 240. As discussed with respect to FIG. 5, the side strap 260 has an elastic portion 264, which allows users to adjust the fit of the assembled vest tactical vest cover kit 200 because the elastic portion 264 stretches, bends, and/or contorts. The fastening portion 262 of the side strap 260 is secured to the front fastener 214 of the front cover portion and the rear fastener 244 of the back cover portion. As discussed with respect to FIG. 5, alternative means of securing the front cover portion 210 to the back cover portion 240 are contemplated. For example, alternative embodiments can use zippers, snap buttons, hook and loop fasteners, or male and female connectors to secure the front cover portion 210 to the back cover portion 240.

FIG. 8 is a perspective view of an assembled tactical vest cover assembled from a tactical vest cover kit 200, according to some embodiments. As depicted in FIG. 8, the user is wearing the assembled tactical vest cover 200. The tactical vest cover kit 200 has been customized for the user because each component of the tactical vest cover kit 200 is trimmed according to the user's body dimensions and/or fit preferences. As discussed with respect to FIGS. 5 and 7, the elastic portion 264 of the side strap 260 aids in obtaining for the user his or her desired fit for the assembled tactical vest cover kit 200 by contorting to the user's body dimensions. If the user desires a snugger or looser fit, the user could adjust how the fastening portions 262 of the side strap 260 fasten to the front fastener 214 of the front cover portion 210 and the rear fastener 244 of the back cover portion 240.

Figure 9:
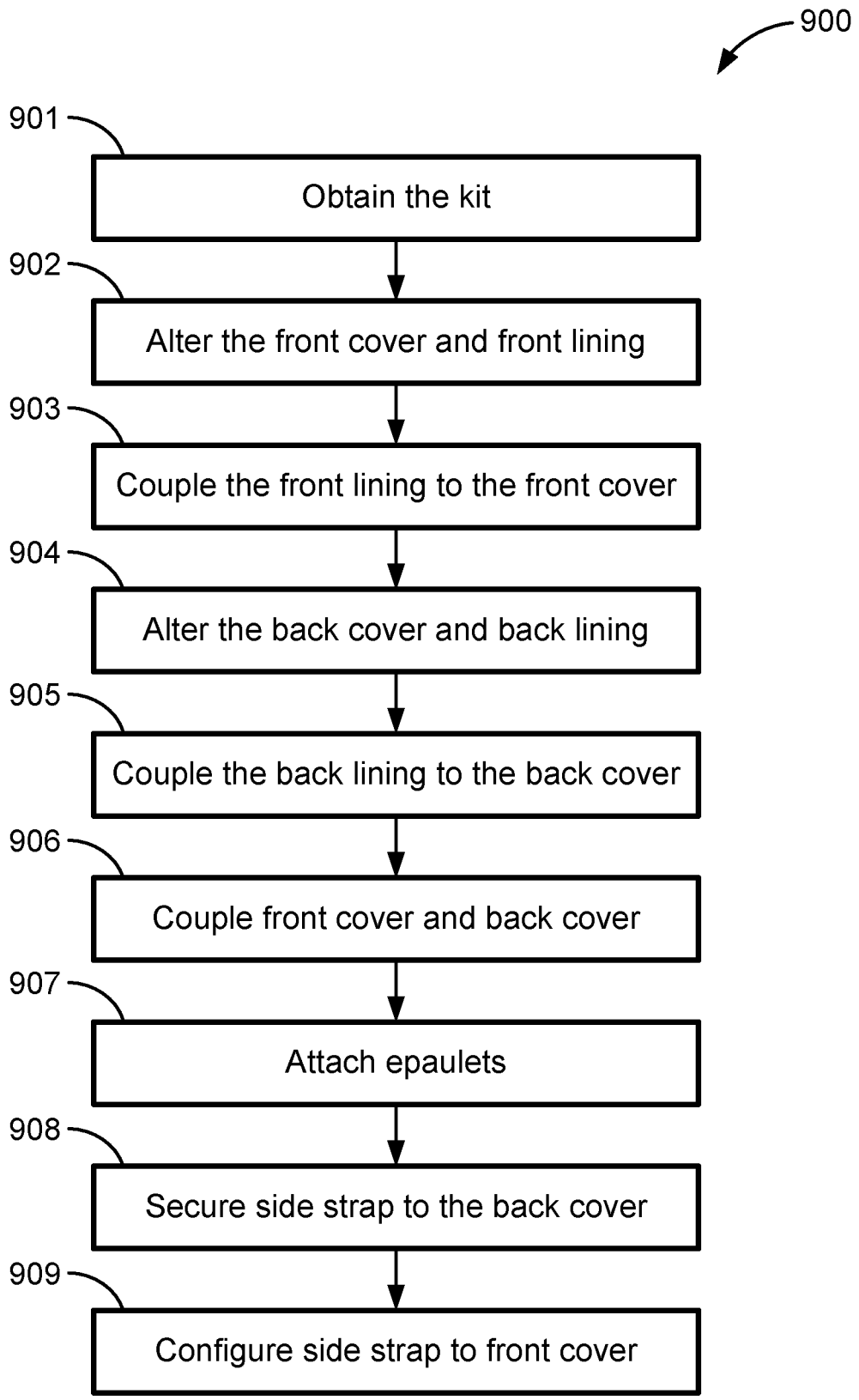
FIG. 9 is a flow chart including example operations for assembling a vest cover using a vest cover kit, according to some embodiments.

While the discussion of FIGS. 1-8 describes variations of vest cover kits, the discussion of FIG. 9 describes a method of assembling a vest cover kit.

FIG. 9 is a flow chart including example operations for assembling a vest cover kit in accordance with several embodiments. The flow begins at step 901.

Step 901 of method 900 includes obtaining a vest cover kit. The vest cover kit can be for any type of vest cover, such as, for example, the uniform vest cover described with respect to FIGS. 1-4 or the tactical vest cover described with respect to FIGS. 5-8. In one embodiment, the vest cover kit includes a front cover, a front lining, a back cover, a back lining, a pair of epaulets, and at least one side strap. For example, in some embodiments, step 901 of method 900 includes obtaining the vest cover kit 100. The vest cover kit includes the front cover portion, the front lining, the back cover portion, the back lining, the pair of epaulets, and at least one side strap. In other embodiments, the vest cover kit additionally includes a pocket liner and/or decorative accessories (e.g., buttons, pockets, name tags, emblems, etc.).

Step 902 of method 900 includes altering the front cover and the front lining. The front cover and the front lining are altered based on the dimensions of a user's chest and/or the user's fit preferences. Using a uniform vest cover kit as an example, at step 902 of the method 900, the front cover portion and the front lining of the uniform vest cover kit are altered based on the dimensions of the user's chest. Additionally, or alternatively, the front cover and the front lining are altered based on the dimensions of the user's inserts (e.g., protective padding and/or bullet proof plates). In such embodiments, the front cover and the front lining can be altered to a dimension that would allow the insert(s) to be securely positioned between the front cover and the front lining.

Step 903 of method 900 includes, after altering the front cover and the front lining, coupling the front lining to the inner surface of the front cover. For example, the front cover and the front lining can be coupled by sewing the front cover and the front lining together. As described herein, the front lining is coupled to an inner surface of the front cover. When coupling the front lining to the front cover, only the outer edges of the front lining are coupled to the front cover. By only coupling the outer edges of the front lining, a user can position an insert (e.g., bullet proof plate, protective padding) between the front lining and the front cover.

Step 904 of method 900 includes altering the back cover and the back lining. The back cover and back front lining are altered based on the dimensions of a user's back and/or the user's fit preferences. Using a uniform vest cover kit as an example, at step 904 of the method 900, the back cover and the back lining of the uniform vest cover kit are altered based on the dimensions of the user's chest. Additionally, or alternatively, the back cover and the back lining are altered based on the dimensions of the user's inserts (e.g., protective padding and/or bullet proof plates). In such embodiments, the back cover and the back lining can be altered to a dimension that would allow the insert(s) to be securely positioned between the back cover and the back lining.

Step 905 of method 900 includes, after altering the back cover and the back lining, coupling the back lining to an inner surface of the back cover. For example, the back cover and the back lining can be coupled by sewing the back cover and the back lining together. As described herein, the back lining is coupled to an inner surface of the back cover. When coupling the back lining to the back cover, only the outer edges of the back lining are coupled to the back cover. By only coupling the outer edges of the back lining, a user can position an insert (e.g., bullet proof plate, protective padding) between the back lining and the back cover.

Step 906 of method 900 includes coupling the front cover to the back cover. In some embodiments, a pair of front shoulder portions of the front cover are coupled to a pair of back shoulder portions of the back cover. In an exemplary embodiment in which the vest cover kit of method 900 is the uniform vest cover kit described with respect to FIGS. 1-4, the front right shoulder edge of the front cover portion is coupled to the rear right shoulder edge of the back cover portion. Similarly, the front left shoulder edge of the front cover portion is coupled to the rear left shoulder edge of the back cover portion.

Step 907 of method 900 includes, after coupling the front cover to the back cover, attaching epaulets. The epaulets are attached to one of the front cover and the back cover or a combination of the front cover and the back cover. Using a uniform vest cover kit as an example, at step 907 of the method 900, each of the pair epaulets are sewn into both the front cover and the back cover at the right shoulder and the left shoulder, respectively.

Step 908 of method 900 includes securing at least one side strap to the back cover. A first of a pair of coupling mechanisms of the side strap is attached to the back cover. In an exemplary embodiment in which the vest cover kit of method 900 is the uniform vest cover kit described with respect to FIGS. 1-4, the side strap includes an elastic portion and a pair of fastening portions. One example of a fastening portion is a hook and loop fastener, as described herein. One of the pair of fastening portions is attached to the rear fastener of the back cover. The fastening portion is attached to the rear fastener via hook and loop fasteners.

Step 909 of method 900 includes, after securing the at least one side strap to the back cover, configuring the second coupling mechanism of the side strap to the front cover so as to couple the front cover and the back cover. A second of the pair of coupling mechanisms of the side strap is attached to the front cover. In an exemplary embodiment in which the vest cover kit of method 900 is the uniform vest cover kit described with respect to FIGS. 1-4, the side strap includes a pair of fastening portions. At step 908, a first of the pair of fastening portions was attached to the rear fastener of the back cover. At step 909, the second of the pair of fastening portions is attached to the front fastener of the front cover. Once the fastening portion is attached to the front fastener, the front cover is coupled to the back cover. The side strap acts as a coupling mechanism to couple the front cover and the back cover.

In some embodiments, the method 900 optionally includes coupling a second side strap to the back cover, and coupling the second side strap to the front cover. In an exemplary embodiment in which the vest cover kit of method 900 is the uniform vest cover kit described with respect to FIGS. 1-4, the uniform vest cover kit includes two side straps. The back cover includes two rear fasteners configured to receive a first of the pair of fastening portions of each side strap. Similarly, the front cover includes two front fasteners configured to receive the second of the pair of fastening portions of each side strap. In this embodiment, the front cover is coupled to the back cover at the right shoulder and left shoulder, and via the use of a pair of side straps. In some embodiments, the front cover can be coupled to the back cover through use of only one side strap, with the other side strap being replaced by a zipper, snap buttons, or male and female connectors as discussed herein.

In some embodiments, the method 900 also includes securing a pocket liner to a surface of the front lining such that the pocket liner forms an interior pocket. In an exemplary embodiment in which the vest cover kit of method 900 is the uniform vest cover kit described with respect to FIGS. 1-4, the uniform vest cover kit includes a pocket liner that is coupled to a surface of the front lining. The pocket liner functions as an interior pocket when the assembled uniform vest cover kit is worn by a user.

The method 900 also optionally includes inserting an insert into the vest cover kit. This optional step includes opening a first pre-installed closure mechanism of the front lining, after the opening of the first pre-installed closure mechanism, inserting a first insert into the first pre-installed closure mechanism of the front lining, after the inserting of the first insert, closing the first pre-installed closure mechanism, thereby maintaining the first insert within the front lining and the front cover, opening a second pre-installed closure mechanism of the back lining, after the opening of the second pre-installed closure mechanism, inserting a second insert into the second pre-installed closure mechanism of the back lining, and after inserting the second insert, closing the second pre-installed closure mechanism, thereby maintaining the second insert within the back lining and the back cover.

A vest cover kit for making a customizable vest cover, the vest cover kit comprising a front cover configured to cover at least a portion of a user's chest, the front cover having at least one pre-installed internal pocket, a front lining configured to be coupled to an inner surface of the front cover, the front lining including a first pre-installed closure mechanism, wherein the first pre-installed closure mechanism allows for insertion of a first insert when the front lining is coupled to the inner surface of the front cover, a back cover configured to cover at least a portion of the user's back, a back lining configured to be coupled to an inner surface of the back cover, the back lining including a second pre-installed closure mechanism, wherein the second pre-installed closure mechanism allows for insertion of a second insert when the back lining is coupled to the inner surface of the back cover, a pair of epaulets configured to be secured to one or more of the front cover and the back cover, and at least one side strap, wherein the at least one side strap is configured to be removably secured to the front cover and the back cover to secure the customizable vest cover on the user.

A vest cover kit for making a customizable vest cover, the vest cover kit comprising a front cover having a left portion and a right portion, the front cover configured to cover at least a portion of a user's chest, wherein the left portion includes a first mating feature and the right portion includes a second mating feature, and wherein the first mating feature and the second mating feature are configured to secure the left portion to the right portion, a front lining configured to be coupled to an inner surface of the front cover, the front lining including a first pre-installed closure mechanism, wherein the first pre-installed closure mechanism allows for insertion of a first insert when the front lining is coupled to the inner surface of the front cover, a back cover configured to cover at least a portion of the user's back, a back lining configured to be coupled to an inner surface of the back cover, the back lining including a second pre-installed closure mechanism, wherein the second pre-installed closure mechanism allows for insertion of a second insert when the back lining is coupled to the inner surface of the back cover, a pair of external pockets, wherein a first one of the external pockets is configured to be secured to the left portion of the front cover and a second one of the external pockets is configured to be secured to the right portion of the front cover, a pair of pocket flaps, wherein a first one of the pocket flaps is configured to be secured to the left portion of the front cover adjacent to the first one of the external pockets and a second one of the pocket flaps is configured to be secured to the right portion of the front cover adjacent to the second one of the external pockets, a pair of epaulets configured to be secured to one or more of the front cover and the back cover; and at least one side strap, wherein the at least one side strap is configured to be removably secured to the front cover and the back cover to secure the customizable vest cover on the user.

In some embodiments, an apparatus and a corresponding method performed by the apparatus, comprises obtaining the kit, kit comprising a front cover configured to cover at least a portion of a user's chest, a front lining configured to be coupled to an inner surface of the front cover, the front lining including a first pre-installed closure mechanism, wherein the first pre-installed closure mechanism allows for insertion of a first insert when the front lining is coupled to the inner surface of the front cover, a back cover configured to cover at least a portion of the user's back, a back lining configured to be coupled to an inner surface of the back cover, the back lining including a second pre-installed closure mechanism, wherein the second pre-installed closure mechanism allows for insertion of a second insert when the back lining is coupled to the inner surface of the back cover, a pair of epaulets configured to be secured to one or more of the front cover and the back cover, at least one side strap, wherein the at least one side strap is configured to be removably secured to the front cover and the back cover to secure the vest on the user, altering, based on dimensions of a user's chest, the front cover and the front lining, after the altering of the front cover and the front lining, coupling the front lining to the inner surface of the front cover, altering, based on dimensions of the user's back, the back cover and the back lining, after the altering of the back cover and the back lining, coupling the back lining to the inner surface of the back cover, coupling a pair of front shoulder portions of the front cover to a pair of back shoulder portions of the back cover, after the coupling of the pair of front shoulder portions to the pair of back shoulder portions, attaching the pair of epaulets to one or more of the front cover and the back cover, securing a first of a pair of coupling mechanisms of the at least one side strap to the back cover, and after the securing, configuring a second of the pair of coupling mechanisms of the at least one side strap to couple the front cover and the back cover by securing the second of the pair of coupling mechanisms to the front cover.

Those skilled in the art will recognize that a wide variety of other modifications, alterations, and combinations can also be made with respect to the above described embodiments without departing from the scope of the disclosure, and that such modifications, alterations, and combinations are to be viewed as being within the ambit of the inventive concept.

What is claimed is:

1. A vest cover kit for making a customizable vest cover, the vest cover kit comprising:

a front cover configured to cover at least a portion of a user's chest, the front cover having at least one pre-installed internal pocket;

a front lining configured to be coupled to an inner surface of the front cover, the front lining being a unitary piece of fabric, the front lining including a first pre-installed closure mechanism, the first pre-installed closure mechanism defining a first opening, wherein a length of the first opening is less than a width of the front lining, wherein the first pre-installed closure mechanism extends substantially horizontally across the front lining such that the first pre-installed closure mechanism divides the front lining into an upper portion and a lower portion, wherein the first pre-installed closure mechanism allows for insertion of a first insert when the front lining is coupled to the inner surface of the front cover, wherein a top edge of the front lining is coupled to the inner surface of the front cover above the first insert and a bottom edge of the front lining is coupled to the inner surface of the front cover below the first insert when the first insert is inserted through the first pre-installed closure mechanism;

a back cover configured to cover at least a portion of the user's back;

a back lining configured to be coupled to an inner surface of the back cover, the back lining being a unitary piece of fabric, the back lining including a second pre-installed closure mechanism, the second pre-installed closure mechanism defining a second opening, wherein a length of the second opening is less than a width of the back lining, wherein the second pre-installed closure mechanism extends substantially horizontally across the back lining such that the second pre-installed closure mechanism divides the back lining into an upper portion and a lower portion, wherein the second pre-installed closure mechanism allows for insertion of a second insert when the back lining is coupled to the inner surface of the back cover, wherein a top edge of the back lining is coupled to the inner surface of the back cover above the second insert and a bottom edge of the back lining is coupled to the inner surface of the back cover below the second insert when the second insert is inserted through the second pre-installed closure mechanism;

a pair of epaulets configured to be secured to one or more of the front cover and the back cover; and at least one side strap, wherein the at least one side strap is configured to be removably secured to the front cover and the back cover to secure the customizable vest cover on the user;

wherein the front cover, the front lining, the back cover, the back lining, the pair of epaulets, and the at least one side strap are provided as separate pieces in the vest cover kit.

2. The vest cover kit of claim 1, wherein the first insert and the second insert are bulletproof plates.

3. The vest cover kit of claim 1, further including a pocket liner configured to be coupled to a surface of the front lining to form an interior pocket.

4. The vest cover kit of claim 1, wherein the at least one side strap includes a pair of coupling mechanisms, wherein the pair of coupling mechanisms are configured to couple the at least one side strap to the front cover and the back cover.

5. The vest cover kit of claim 4, wherein the front cover includes a pair of front shoulder portions and the back cover includes a pair of back shoulder portions, and wherein the pair of front shoulder portions are configured to be coupled to the pair of back shoulder portions.

6. The vest cover kit of claim 1, wherein a size of the front cover, a size of the front lining, a size of the back cover, and a size of the back lining are selected based on a size of the user.

7. The vest cover kit of claim 1, wherein at least one of the front cover, the front lining, the back cover, and the back lining are configured to be altered before the customizable vest cover is assembled.

8. The vest cover kit of claim 1, wherein the first pre-installed closure mechanism is a zipper.

9. A vest cover kit for making a customizable vest cover, the vest cover kit comprising:

a front cover having a left portion and a right portion, the front cover configured to cover at least a portion of a user's chest, wherein the left portion includes a first mating feature and the right portion includes a second mating feature, and wherein the first mating feature and the second mating feature are configured to secure the left portion to the right portion;

a front lining configured to be coupled to an inner surface of the front cover, the front lining being a unitary piece of fabric, the front lining including a first pre-installed closure mechanism, the first pre-installed closure mechanism defining a first opening, wherein a length of the first opening is less than a width of the front lining, wherein the first pre-installed closure mechanism extends substantially horizontally across the front lining such that the first pre-installed closure mechanism divides the front lining into an upper portion and a lower portion, wherein the first pre-installed closure mechanism allows for insertion of a first insert when the front lining is coupled to the inner surface of the front cover, wherein a top edge of the front lining is coupled to the inner surface of the front cover above the first insert and a bottom edge of the front lining is coupled to the inner surface of the front cover below the first insert when the first insert is inserted through the first pre-installed closure mechanism;

a back cover configured to cover at least a portion of the user's back;

a back lining configured to be coupled to an inner surface of the back cover, the back lining being a unitary piece of fabric, the back lining including a second pre-installed closure mechanism, the second pre-installed closure mechanism defining a second opening, wherein a length of the second opening is less than a width of the back lining, wherein the second pre-installed closure mechanism extends substantially horizontally across the back lining such that the second pre-installed closure mechanism divides the back lining into an upper portion and a lower portion, wherein the second pre-installed closure mechanism allows for insertion of a second insert when the back lining is coupled to the inner surface of the back cover, wherein a top edge of the back lining is coupled to the inner surface of the back cover above the second insert and a bottom edge of the back lining is coupled to the inner surface of the back cover below the second insert when the second insert is inserted through the second pre-installed closure mechanism;

a pair of external pockets, wherein a first one of the external pockets is configured to be secured to the left portion of the front cover and a second one of the external pockets is configured to be secured to the right portion of the front cover;

a pair of pocket flaps, wherein a first one of the pocket flaps is configured to be secured to the left portion of the front cover adjacent to the first one of the external pockets and a second one of the pocket flaps is configured to be secured to the right portion of the front cover adjacent to the second one of the external pockets;

a pair of epaulets configured to be secured to one or more of the front cover and the back cover; and at least one side strap, wherein the at least one side strap is configured to be removably secured to the front cover and the back cover to secure the customizable vest cover on the user;

wherein the front cover, the front lining, the back cover, the back lining, the pair of external pockets, the pair of pocket flaps, the pair of epaulets, and the at least one side strap are provided as separate pieces in the vest cover kit.

10. The vest cover kit of claim 8, wherein the first insert and the second insert are bulletproof plates.

11. The vest cover kit of claim 9, further including a pocket liner configured to be coupled to a surface of the front lining to form an interior pocket.

12. The vest cover kit of claim 9, wherein the at least one side strap includes a pair of coupling mechanisms, wherein the pair of coupling mechanisms are configured to couple the at least one side strap to the front cover and the back cover.

13. The vest cover kit of claim 12, wherein the front cover includes a pair of front shoulder portions and the back cover includes a pair of back shoulder portions, and wherein the pair of front shoulder portions are configured to be coupled to the pair of back shoulder portions.

14. The vest cover kit of claim 9, wherein a size of the front cover, a size of the front lining, a size of the back cover, and a size of the back lining are selected based on a size of the user.

15. The vest cover kit of claim 9, wherein at least one of the front cover, the front lining, the back cover, and the back lining are configured to be altered before the customizable vest cover is assembled.

16. A method of assembling a vest cover using a vest cover kit, the method comprising:

obtaining the vest cover kit, the vest cover kit comprising:

a front cover configured to cover at least a portion of a user's chest;

a front lining configured to be coupled to an inner surface of the front cover, the front lining being a unitary piece of fabric, the front lining including a first pre-installed closure mechanism, the first pre-installed closure mechanism defining a first opening, wherein a length of the first opening is less than a width of the front lining, wherein the first pre-installed closure mechanism extends substantially horizontally across the front lining such that the first pre-installed closure mechanism divides the front lining into an upper portion and a lower portion, wherein the first pre-installed closure mechanism allows for insertion of a first insert when the front lining is coupled to the inner surface of the front cover, wherein a top edge of the front lining is coupled to the inner surface of the front cover above the first insert and a bottom edge of the front lining is coupled to the inner surface of the front cover below the first insert when the first insert is inserted through the first pre-installed closure mechanism;

a back cover configured to cover at least a portion of the user's back;

a back lining configured to be coupled to an inner surface of the back cover, the back lining being a unitary piece of fabric, the back lining including a second pre-installed closure mechanism, the second pre-installed closure mechanism defining a second opening, wherein a length of the second opening is less than a width of the back lining, wherein the second pre-installed closure mechanism extends substantially horizontally across the back lining such that the second pre-installed closure mechanism divides the back lining into an upper portion and a lower portion, wherein the second pre-installed closure mechanism allows for insertion of a second insert when the back lining is coupled to the inner surface of the back cover, wherein a top edge of the back lining is coupled to the inner surface of the back cover above the second insert and a bottom edge of the back lining is coupled to the inner surface of the back cover below the second insert when the second insert is inserted through the second pre-installed closure mechanism;

a pair of epaulets configured to be secured to one or more of the front cover and the back cover;

at least one side strap, wherein the at least one side strap is configured to be removably secured to the front cover and the back cover to secure the vest on the user;

wherein the front cover, the front lining, the back cover, the back lining, the pair of epaulets, and the at least one side strap are provided as separate pieces in the vest cover kit;

altering, based on dimensions of a user's chest, the front cover and the front lining;

after the altering of the front cover and the front lining, coupling the front lining to the inner surface of the front cover;

altering, based on dimensions of the user's back, the back cover and the back lining;

after the altering of the back cover and the back lining, coupling the back lining to the inner surface of the back cover;

coupling a pair of front shoulder portions of the front cover to a pair of back shoulder portions of the back cover;

after the coupling of the pair of front shoulder portions to the pair of back shoulder portions, attaching the pair of epaulets to one or more of the front cover and the back cover;

securing a first of a pair of coupling mechanisms of the at least one side strap to the back cover; and after the securing, configuring a second of the pair of coupling mechanisms of the at least one side strap to couple the front cover and the back cover by securing the second of the pair of coupling mechanisms to the front cover.

17. The method of claim 16, further comprising:

opening a first pre-installed closure mechanism of the front lining;

after the opening of the first pre-installed closure mechanism, inserting a first insert into the first pre-installed closure mechanism of the front lining;

after the inserting of the first insert, closing the first pre-installed closure mechanism, thereby maintaining the first insert within the front lining and the front cover;

opening a second pre-installed closure mechanism of the back lining;

after the opening of the second pre-installed closure mechanism, inserting a second insert into the second pre-installed closure mechanism of the back lining; and after inserting the second insert, closing the second pre-installed closure mechanism, thereby maintaining the second insert within the back lining and the back cover.

18. The method of claim 16, wherein the at least one side strap includes a first side strap and a second side strap.

19. The method of claim 18, further comprising:

after the configuring of the second of the pair of coupling mechanisms of the at least one side strap, securing the first of the pair of coupling mechanisms of the second side strap to the back cover;

after the securing of the first of the pair of coupling mechanisms of the second side strap, configuring the second of the pair of coupling mechanisms of the second side strap to couple the front cover and the back cover by securing the second of the pair of couple mechanisms to the front cover, wherein the second side strap is positioned opposite the first side strap.

20. The method of claim 16, further comprising:

after coupling the front lining to the inner surface of the front cover, coupling a pocket liner to a surface of the front lining such that the pocket liner forms an interior pocket.

* * * * *